US006363877B1

(12) United States Patent
Craddock

(10) Patent No.: US 6,363,877 B1
(45) Date of Patent: Apr. 2, 2002

(54) POWER BOAT

(76) Inventor: Ronald Leonard Craddock, 18 Edelmaier Street, Bayswater, Victoria 3153 (AU)

( * ) Notice: Subject to any disclaimer, the term of this patent is extended or adjusted under 35 U.S.C. 154(b) by 0 days.

(21) Appl. No.: 09/604,061

(22) Filed: Jun. 26, 2000

(30) Foreign Application Priority Data

Jun. 29, 1999 (AU) ..... PQ1266

(51) Int. Cl.[7] ..... B63B 1/20
(52) U.S. Cl. ..... 114/271; 114/291; 114/362
(58) Field of Search ..... 114/271, 291, 114/362

(56) References Cited

U.S. PATENT DOCUMENTS 1,848,018 A * 3/1932 Maranville ..... 114/291
1,880,366 A * 10/1932 Smedley ..... 114/271
4,231,314 A * 11/1980 Peters ..... 114/291
4,519,336 A * 5/1985 Mason ..... 114/286
4,742,795 A * 5/1988 DePrey et al. ..... 114/362
5,572,944 A * 11/1996 Slikkers et al. ..... 114/362
5,819,677 A * 10/1998 Livingston ..... 114/271

* cited by examiner

*Primary Examiner*—Sherman Basinger
(74) *Attorney, Agent, or Firm*—Curtis L. Harrington

(57) ABSTRACT

The power boat includes a bow and a stern, a hull with a longitudinal dimension extending from the bow to the stern, and a platform extending across the stern for enabling boarding of the boat, the platform being located at or slightly above the water surface when the boat is stationary in the water. The hull has a planing zone located at a stern region of the hull shaped so that a longitudinal line extending along the surface of the hull from the bow to the stern upon reaching the planing zone turns upwardly towards the water surface relative to the longitudinal line forwardly of and before reaching the planing zone. When the boat is travelling through the water at speed, drag of the water travelling relatively along the planing zone assists stable travel of the boat through the water. The planing zone is located below the boarding platform. A drive motor located inboard of the boat and drive components located beneath the planing zone of the hull, and particularly located beneath the transom or beneath the boarding platform impart thrust to the boat. Strakes can extend longitudinally along the hull at positions forwardly of the planing zone.

6 Claims, 2 Drawing Sheets

POWER BOAT

FIELD OF THE INVENTION

This invention relates to power boats, such as ski boats having inboard drive systems.

BACKGROUND OF THE INVENTION

It is known to provide power boats with a boarding platform across the back behind the transom, this boarding platform being provided at a level to be located slightly above water level when the boat is stationary in the water. This enables a skier for example to climb aboard the boat or to enter the water behind the boat with relative ease. In some known boats, particularly some United States designs, such platforms are made of teak and the platforms are secured to the stern as an attachment. Some other boat designs have a relatively narrow platform formed as an integral part of the shape of the stern or transom area.

One common problem associated with such boarding platforms across the back of power boats is that upon rapid deceleration a "stern wave" can flow over the platform and can rise or splash up over the stern and into the boat. To explain this more fully, when a power boat travelling at speed is quickly decelerated and the boat rapidly settles back down into the water from its elevated planing position, the "stern wave" that forms immediately behind the trough in the water surface behind the stern of the boat can catch up with and overtake the boat thus overflowing the boarding platform and splashing up or rising over the transom.

OBJECT OF THE INVENTION

It is an object of the present invention to provide a power boat having features which can alleviate the abovementioned problem or disadvantage associated with the stern wave flowing over a boarding platform.

SUMMARY OF THE INVENTION

According to the present invention there is provided a power boat including a bow and a stern, the boat having a hull with a longitudinal dimension extending from the bow of the boat to the stern of the boat, the boat also having a platform extending across the stern for enabling boarding of the boat, the platform being located substantially at or slightly above the water surface when the boat is stationary in the water, the hull having a planing zone located at a stern region of the hull in the vicinity of the stern of the boat, the planing zone being shaped so that a longitudinal line extending along the surface of the hull in the direction of the longitudinal dimension from the bow to the stern upon reaching the planing zone turns upwardly towards the water surface relative to the longitudinal line forwardly of and before reaching the planing zone, the planing zone providing a zone of the hull where, when the boat is travelling through the water at speed, drag of the water travelling relatively along the planing zone assists stable travel of the boat through the water.

It should be noted that in referring to the longitudinal line extending along the hull as turning "upwardly", it is not intended to limit the direction of the longitudinal line to being inclined upwardly relative to a horizontal line and towards the water surface. For example, if the longitudinal line extending along the hull surface forward of the planing zone is inclined downwardly in a direction from the bow to the stern (considering tangents to the hull at points along the longitudinal line), the line could turn back towards a horizontal direction upon reaching the planing zone and this would still qualify as "turning upwardly towards the water surface relative to the longitudinal line forwardly of and before reaching the planing zone". This interpretation of the expression "turns upwardly" applies throughout this specification, including the claims.

Preferably the planing zone is located below the boarding platform. In this embodiment, preferably the boat includes a transom extending across the stern of the boat and which rises upwardly from a forward end of the boarding platform, the hull including a transition region where the longitudinal line extending along the hull surface turns relatively upwardly and demarcates the start of the planing zone, the transition region being located generally directly below the transom.

The power boat includes drive means preferably including a drive motor and drive components beneath the boat for imparting thrust to the boat. In the preferred embodiment, the drive motor is located inboard and may for example comprise an engine located in a mid position along the longitudinal length of the hull. Preferably the drive components beneath the boat are located beneath the planing zone of the hull. In the preferred embodiment this will entail locating the drive components beneath the boarding platform. Alternatively the drive components may be located generally below the transom immediately forward of the boarding platform.

The drive components may include a propeller mounted to a drive shaft extending from the drive motor, the drive shaft and propeller being located and supported in their desired position beneath the planing zone by a skeg projecting downwardly from the hull, the skeg having a bearing at its bottom extremity through which the drive shaft extends, the propeller being located immediately astern of the skeg. Because in the preferred embodiment the propeller is located at a position below or behind the transom and beneath the boarding platform, the drive shaft will be longer than an otherwise similarly dimensioned and configured power boat and the drive shaft will extend at a shallower angle to the horizontal because it is effectively extending from the drive motor to a rearwardly displaced propeller. For example, the drive shaft may be at an angle of about 12° to the horizontal calculated when the boat is stationary. By providing the relatively shallow angle of the drive shaft, a greater relative component of thrust produced is in a forwards direction, i.e. there is less lifting thrust and this may enable greater travelling speed to be achieved compared to an otherwise similarly configured and powered power boat. Also, the effective displacement of the propeller further astern and the provision of the drive motor generally midway along the length, will mean that the centre of mass or point of balance of the boat is relatively further forward. This might normally be expected to cause the boat to drop or pitch over its point of balance at speed but it has been found that by inclining the planing zone commencing at the skeg relatively upwardly towards the water surface, the planing angle of the boat is nevertheless maintained at high speed. Furthermore, when the boat decelerates and drops down from its planing angle, the boat adopts a very flat position and only a very weak stern wave is generated. In a prototype of the boat according to the invention, upon the boat dropping down rapidly from high speed planing, there was insufficient energy in the stern wave to mount the boarding platform.

To further assist the travelling stability and drive efficiency, strakes are preferably provided on the hull to provide lift to the hull at positions forwardly of the planing zone by deflecting water laterally as the hull travels through the water. In the preferred embodiment, the hull is generally V-shaped in transverse section having a keel at its lowest point, the strakes being provided at each side of the hull displaced laterally from the keel and extending generally longitudinally but terminating before reaching the planing zone whereby there is increased drag astern of the strakes and at the stern region of the hull. As the boat hull travels at speed through the water, the water relatively flowing along the hull from the elevated bow encounters the strakes and is deflected laterally thus reducing drag on the hull and providing lift for the bow end of the hull.

BRIEF DESCRIPTION OF THE DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DESCRIPTION OF PREFERRED EMBODIMENT

Figure 1:
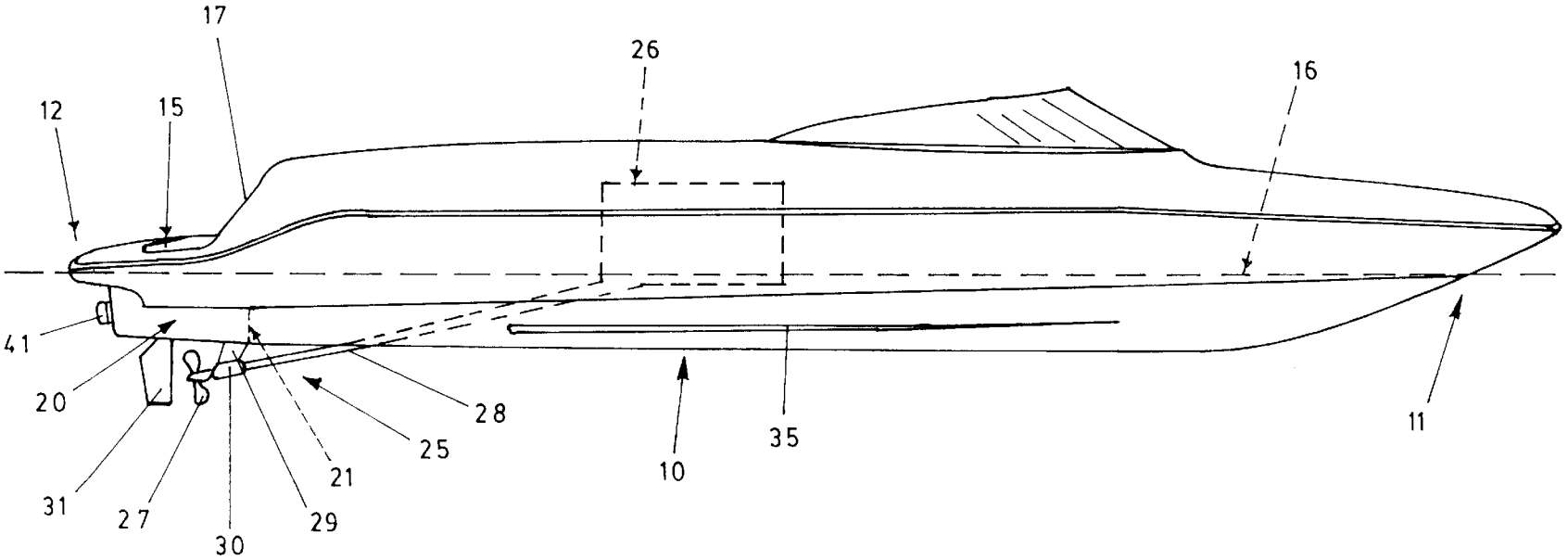
FIG. 1 is a side view of a power boat according to an embodiment of the present invention.
Figure 2:
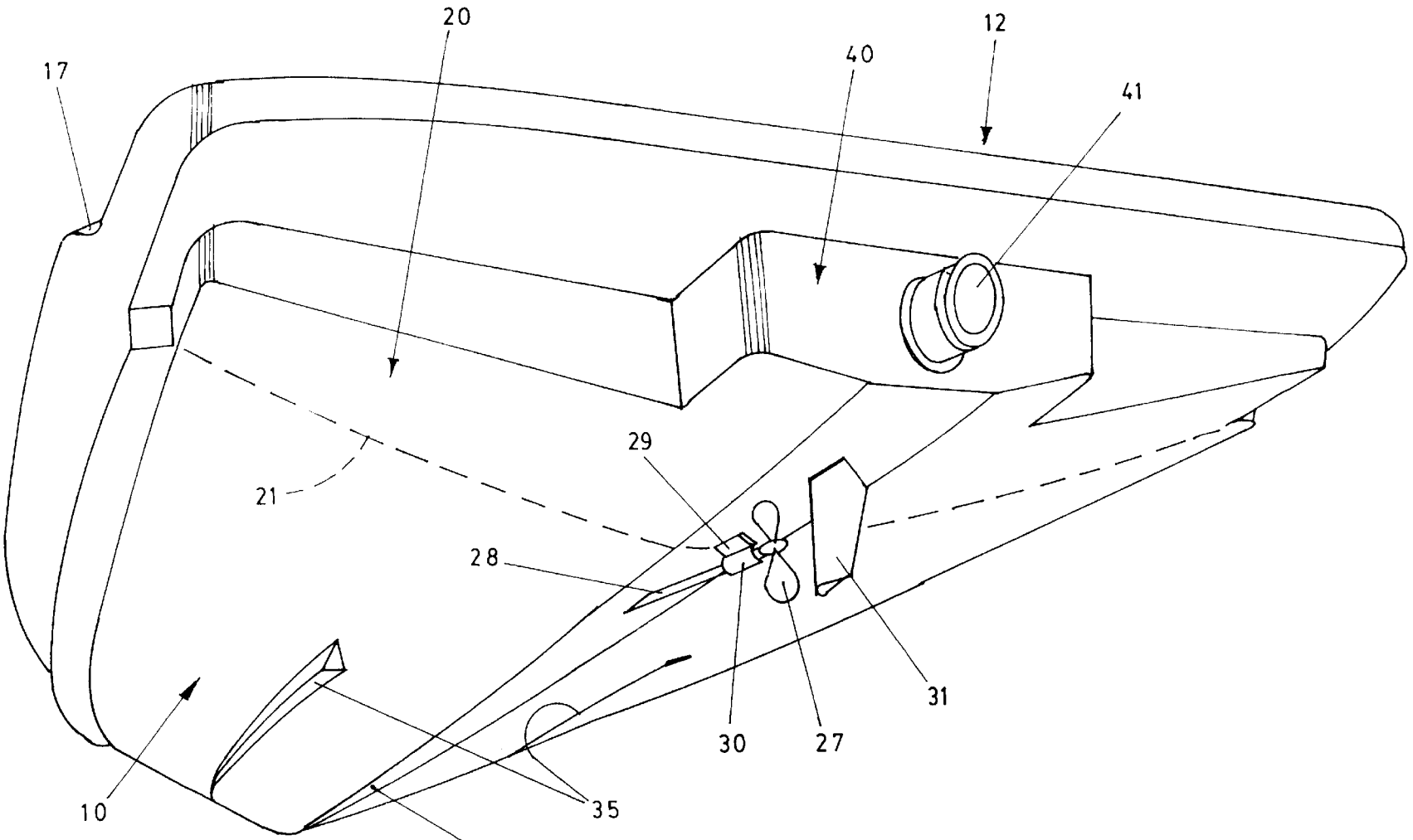
FIG. 2 is an underneath perspective view of the hull of the boat in FIG. 1 from astern

The power boat according to the present invention in the drawings includes a hull 10 having a longitudinal dimension extending from a bow end 11 to a stern 12. A boarding platform 15 extends across the stern slightly above the water surface 16 when the boat is stationary in the water. The hull 10 is provided with a planing zone 20 at the stern region. As seen better in FIG. 1, the planing zone 20 is shaped so that a longitudinal line extending along the hull surface in a direction from the bow 11 to the stern 12 upon reaching the planing zone 20 at the point 21 turns slightly upwardly towards the water surface 16 relative to the longitudinal line forwardly of and before reaching the planing zone 20. When the boat is travelling through the water at speed, the planing zone 20 provides a zone where drag of the water travelling relatively along the planing zone helps enable stable travel of the boat through the water.

The planing zone 20 is located below the boarding platform 15. The transition point or region 21 where the longitudinal line of the hull turns relatively upwardly and demarcating the start of the planing zone 20 is generally directly below the transom 17 at the forward end of the boarding platform 15.

The power boat includes drive means 25 including a drive motor 26 and drive components (27, 28, 29) beneath the boat for imparting thrust to the boat. In the preferred embodiment illustrated, the drive motor 26 is located inboard and may, for example, comprise an engine located in a mid position along the longitudinal length of the hull. Preferably the drive components beneath the boat are located beneath the planing zone 20 of the hull, although they may be slightly more forward so as to be directly below the transom 17.

The drive components include a propeller 27 mounted to a drive shaft 28 extending from the drive motor 26, the drive shaft and propeller being located and supported beneath 10 the planing zone 20 by a skeg 29 projecting downwardly from the hull and having a bearing 30 at its bottom extremity through which the drive shaft 28 extends and the propeller 27 being located immediately astern of the skeg 29. Because in the preferred embodiment the propeller 27 is located at or behind the transom 17 and beneath the boarding platform 15, the drive shaft 28 is longer than an otherwise similarly dimensioned and configured power boat and the drive shaft extends at a shallower angle to the horizontal because it is effectively extending from the drive motor 26 to a rearwardly displaced propeller. The drive shaft 28 may be at an angle of about 12° to the horizontal calculated when the boat is stationary. A rudder 31 is provided behind the propeller 27.

The box shaped region 40 beneath the platform 15 and astern of the rudder 31 provides a housing for the exhaust outlet 41 which needs to be astern of the rudder 31.

To further assist the travelling stability and drive efficiency, strakes 35 are provided on the hull to provide lift to the hull at positions forwardly of the planing zone 20 by deflecting water laterally as the hull travels through the water. The strakes 35 are provided at each side of the hull displaced laterally from the keel 13 of the V hull and extend generally longitudinally but terminate before reaching the planing zone 20 so that there is increased drag at the stern region of the hull. As the boat hull travels at speed through the water with the bow 11 raised, the water relatively flowing along the hull from the elevated bow encounters the strakes 35 and is deflected laterally thus reducing drag on the hull and providing lift for the bow end of the hull.

The boat of the illustrated preferred embodiment has its point of balance further forward than a similar length boat of otherwise similar configuration, but it has been found that the boat, contrary to what may be expected, does not drop or pitch over its point of balance at speed. By changing the angle of the bottom at the stern (the "planing zone"), starting at about the point where the skeg is located, and by careful positioning of the strakes to give lift at the front and terminating the strakes so that they do not interfere with the drag at the stern, the planing angle of the boat is maintained at high speed. Also the boat sits very flat when dropping off the plane and only a very weak stern wave is generated, and there is insufficient energy in the stern wave to mount the boarding platform and rise up the transom to splash or enter the boat.

It is to be understood that various alterations, modifications and/or additions may be made to the features of the possible and preferred embodiment(s) of the invention as herein described without departing from the spirit and scope of the invention as defined in the claims.

What is claimed is:

1. A power boat including a bow and a stern, the boat having a hull with a longitudinal dimension extending from the bow of the boat to the stern of the boat, the boat also having a boarding platform extending across the stern for enabling boarding of the boat, the boarding platform being located substantially or slightly above the water surface when the boat is stationary in the water, the hull having a planing zone located at a stern region of the hull in the vicinity of the stern of the boat and being located below the boarding platform, the planing zone being shaped so that a longitudinal line extending along the surface of the hull in the direction of the longitudinal dimension from the bow to the stern upon reaching the planing zone turns upwardly towards the water surface relative to the longitudinal line forwardly of and before reaching the planing zone, the planing zone providing a zone of the hull where, when the boat is traveling through the water at speed, drag of the water traveling relatively along the planing zone assists stable travel of the boat through the water, the boat further including a transom extending across the stern of the boat and which rises upwardly from a forward end of the boarding platform, the hull including a transition region where the longitudinal line extending along the hull surface turns relatively upwardly and demarcates the start of the planing zone, the transition region being located generally directly below the transom.

2. A power boat as claimed in claim 1 and further including drive means including a drive motor located inboard of the boat and drive components located beneath the boat for imparting thrust to the boat, the drive components beneath the boat being located beneath the planing zone of the hull.

3. A power boat claimed in claim 2 wherein the drive compoments include a propeller mounted to a drive shaft extending from the drive motor, the drive shaft and propeller being located and supported ion their desired position beneath the planing zone by a skeg projecting downwardly from the hull, the sleg having a bearing at its bottom extremity through which the drive shaft extends, the propeller being located immediately astern of the skeg.

4. A power boat as claimed in claim 1 and further including drive means including a drive motor located inboard of the boat and drive components located beneath the boat for imparting thrust to the boat, the drive components beneath the boat being located generally below the transom at the forward end of the boarding platform.

5. A power boat as claimed in claim 1 and further including strakes extending longitudinally along the hull, the strakes being provided at positions forwardly of the planing zone and being arranged to provide lift to the hull by deflecting water laterally as the hull travels through the water.

6. A power boat as claimed in claim 5 wherein the hull is generally V-shaped in transverse section having a keel at its lowest point, the strakes being provided at each side of the hull displaced laterally from the keel and extending generally longitudinally but terminating before reaching the planing zone whereby there is increased drag astern of the strakes and at the stern region of the hull.

* * * * *